United States Patent [19]

Bodendorf

[11] 4,315,798

[45] Feb. 16, 1982

[54] DECAY RESISTANT SHEET MATERIAL WITH RETAINED FLEXIBILITY

[75] Inventor: Warren J. Bodendorf, Montgomery, Mass.

[73] Assignee: Texon Inc., South Hadley, Mass.

[21] Appl. No.: 177,778

[22] Filed: Aug. 13, 1980

[51] Int. Cl.[3] ..... D21H 5/22

[52] U.S. Cl. ..... 162/161; 162/168 R; 162/168 NA; 162/169

[58] Field of Search ..... 162/161, 146, 168 NA, 162/168 R, 169

[56] References Cited

U.S. PATENT DOCUMENTS

| | | | |
|---|---|---|---|
| 3,493,464 | 2/1970 | Bowers et al. | 162/161 |
| 3,790,529 | 2/1974 | Fujimura et al. | 162/168 NA |
| 3,918,981 | 11/1975 | Long | 162/161 |
| 4,018,647 | 4/1977 | Wietsma | 162/169 |

FOREIGN PATENT DOCUMENTS 50-13610 2/1975 Japan .

*Primary Examiner*—William F. Smith

*Attorney, Agent, or Firm*—Webb, Burden, Robinson & Webb

[57] ABSTRACT

Synthetic sheet material is resistant to decay by fungus and other microbial organisms and particularly useful in shoe construction where flexibility is required. The material comprises a uniform distribution of cellulose and optionally synthetic fiber within an acrylic elastomeric matrix or binder and is formed from a furnish of the fibers; a metallic quinolinolate which lends the material decay resistant; a polymer colloid such as an acrylic latex which prevents the coagulation of the subsequently added acrylic elastomeric binder by the metallic quinolinolate; and a cationic polymer which acts as a retaining agent for the metallic quinolinolate in the synthetic sheet material.

5 Claims, No Drawings

DECAY RESISTANT SHEET MATERIAL WITH RETAINED FLEXIBILITY

BACKGROUND OF THE INVENTION

1. Field of the Invention

This invention relates to decay resistant sheet material and more particularly to such materials adapted for use in shoe construction.

2. Description of the Prior Art

For purposes of economy, it has been the practice to employ synthetic sheet material in the manufacture of shoes. Such "shoeboard" as it has come to be known, comprises a disposition of an elastomeric binder and particularly a neoprene or styrene-butadiene elastomer in a fibrous matrix and is currently in fairly extensive use in counters and shoe insoles. For durability, especially where the shoeboard is employed in tropical climates, the board must be treated with a substance which provides the board with resistance to decay by fungus and other microbial organisms, a property not naturally possessed by leather and other shoe construction constituents unless treated chemically.

Metallic quinolinolates, particularly copper-quinolinolate effectively render some cellulosic materials resistant to fungus and bacteria. However, due to environmental and economic considerations they have not been successfully employed as a preservative or fungicide in shoeboard due to difficulty in processing and retention within the shoe materials over an extended period of time. In addition, it has been found that metallic quinolinolates degrade the flexural property of the shoeboard over time when used in combination with neoprene or styrene-butadiene binders.

Prior art attempts to incorporate the metallic quinolinolates in a cellulosic sheet have proved less than satisfactory. For example, incorporation of the powdered form of the metallic quinolinolate by adding it to the paper slurry before deposition on the wire has proved ineffective due to low retention causing an effluent from the papermaking process which contains unacceptably high levels of metallic quinolinolates. Further, it is unacceptable to lose these amounts of metallic quinolinolates since they are expensive and it is desirable to have effective utilization of the quinolinolate. Further, size press application of a solubilized form of the copper-quinolinolate is also ineffective due to the leachability of the same by water.

Methods such as those disclosed in U.S. Pat. No. 3,493,464 to Bowers et al. and U.S. Pat. No. 3,713,963 to Hager demonstrate retention rates of approximately 70% of the theoretical by formation of the metallic quinolinolate in the pulper by the proper addition of the required compounds and precipitation thereof, in situ, of the insoluble salt. However, methods are also suggested to treat the paper machine effluent in order to remove the remaining quinolinolate therefrom.

Furthermore, it has been observed that the copper-quinolinolate, being incompatible with the other popular insole binders namely, neoprene and styrene-butadiene rubber causes the coagulation of such binders, thereby severely adversely affecting the uniform saturation of the web with the binder along with the strength and resilience thereof.

Accordingly, it is an object of the present invention to provide a fungus and mold resistant synthetic sheet material which overcomes the deficiencies associated with the prior art.

It is another object of the present invention to provide a fungus and mold resistant sheet material employing a metallic quinolinolate as a fungicide.

It is another object of the present invention to provide a fungus and mold resistant sheet material of optimal strength and resilience.

It is another object of the present invention to provide a method of economically making a fungus and mold resistant sheet material with a fungicide which is retained by the sheet material at substantially maximum rates during the fabrication process. It is another object of the present invention to provide a fungus and mold resistant material which retains the fungicide therein over long periods of time.

It is another object of the present invention to provide a method of making fungus and mold resistant material wherein substantially none of metallic ions from a fungicide in the material are lost in the effluent or waste water.

These and other objects will become more readily apparent from the following summary of the invention and detailed description thereof.

SUMMARY OF THE INVENTION

A fungus and mold resistant sheet material is manufactured from a furnish containing a fibrous pulp, an ionic emulsion of a metallic quinolinolate as a fungicide and a cationic polymer for optimization of the retention of the metallic quinolinolate. The furnish further includes a polymer colloid compatible with both the metallic quinolinolate and an acrylic elastomeric binder added in a subsequent step; the polymer colloid serves to prevent the metallic quinolinolate from causing the coagulation of the binder. The furnish is then formed into a web which is saturated with the binder, dried and calendered. The sheet material retains its flexural properties upon aging.

DETAILED DESCRIPTION OF THE INVENTION

In accordance with the present invention the decay resistant sheet material is formed generally by a papermaking process and the resulting sheet may be subsequently laminated to similar sheets to achieve any desired thickness, strength and stiffness.

In the manufacture of the sheet material, a furnish is first formed comprising a fibrous pulp and a cationic polymer. The fibers employed are primarily cellulosic fibers such as ordinary kraft cook fibers or the more highly cooked wood cellulose such as the high alpha, sulfate types used as nitration grade, as well as jute, hemp, mercerized kraft and the like. A minor amount of the fibers may be synthetic such as acrylic, polyester, polyamide and the like, although such synthetic fibers are not strictly necessary. Preferably, the synthetic fibers may be used at a level of up to about 5% by weight based on the total weight of the fibrous constituents.

The cationic polymer is added to the pulp at a concentration of 0.4 to 2.0, and preferably 0.7 to 0.9 parts by weight based upon 100 parts by weight of the pulp, depositing on the surfaces of the fibers and providing association sites for the subsequently added metallic quinolinolate. In the preferred embodiment the cationic polymer is a polyelectrolyte sold under the trade name LUFAX 295 by Rohm & Haas Company and is added to the pulp as a 1.0 to 6.0 percent by weight aqueous solution. In addition to the cationic polyelectrolyte hereinbefore specified, cationic polyacrylamide polymers are also useful as the cationic polymer. The cationic polymer is provided in order to retain the metallic quinolinolate within the web during processing and additionally to retain the metallic quinolinolate within the sheet material during its use as shoeboard and the like. The use of the cationic polymer to retain metallic quinolinolates in sheet material for enhanced decay resistance is disclosed in U.S. patent application No. 177,779 filed the same day as this application and entitled "Decay Resistant Material" of Warren J. Bodendorf and Alphonse Presto, incorporated herein by reference.

The metallic quinolinolate emulsion, preferably a copper-8-quinolinolate is then added in the form of an emulsion to the pulp solution at a concentration of 5 to 12 parts by weight to 100 parts by weight of pulp. The copper-8-quinolinolate is provided in the form of an anionic emulsion, and is readily bonded to the cationic polymer at the fiber surfaces. Such an emulsion is available from Ventron Corp. under the name CUNNILATE 2419-75 containing 37.5% weight solids, 7.5% of which comprises copper-8-quinolinolate.

After the addition of the metallic quinolinolate, the pH of the mixture is raised approximately to between 8 and 11 and preferably about 8.5 by the addition of a suitable alkali salt such as sodium aluminate or the like. A polymer colloid is also added to prevent coagulation of the subsequently added saturant binder. The polymer colloid may be any latex which is compatible with the quinolinolate and the saturant binder. Preferably, the concentration of the polymer colloid is 5 to 12 parts by weight per 100 parts fiber.

In a preferred embodiment, the polymer colloid may comprise either an acrylic latex such as a heat reactive polyacrylate sold by B. F. Goodrich Co. under the trade name HYCAR 2600X112 or a heat reactive polyacrylate sold by Polymerics, Inc. under the trade name of Poly M-410. A dye may be added with the polymer to achieve any desired color of the sheet material.

The furnish is then formed into a web by any suitable apparatus such as, for example, a Fourdrinier machine, and the web is then wet-web saturated with a suitable binder and preferably an elastomeric binder in order to maintain the integrity of the sheet while enhancing the strength and resiliency thereof.

The binders useful in the practice of the invention are those which maintain the integrity of the sheet and do not degrade the flexural properties of the sheet upon aging. This retained flexural property is accomplished by the use of an acrylic elastomeric binder. The term "acrylic elastomer" as used herein, is meant to encompass polymers which in their cured state have an extensibility of at least 200% and a memory of at least 90% when stretched within their extensibility limits and released instantaneously. The acrylic elastomers useful in the practice of the invention may include small amounts of polymerized monomers having conjugated unsaturation, but necessarily include a major amount of monoethylenically unsaturated monomers. The monoethylenically unsaturated monomers are, but not limited to, the acrylic monomers such as methacrylic acid, acrylic acid, acrylonitrile, methacrylonitrile, methylacrylate, methylmethacrylate, ethylmethacrylate, and the like; monoethylenically unsaturated hydrocarbons such as ethylene, butadiene, propylene, styrene, alpha-methylstyrene and the like; and other functional unsaturated monomers such as vinylpyridine, vinylpyrrolidone, acrylamide and the like functional vinylic monomers. The polymers may be self-reactive or known crosslinking agents can be added.

When the sheet material is to be used in the construction of shoes and must exhibit flexibility over its life time, the acrylic elastomers are necessary because the flexibility properties of the sheet material fabricated with the acrylic elastomers do not substantially degrade over time.

After wet-web saturation, the web is calendered to a suitable gauge and dried. The resulting sheet exhibits a substantially complete retention of the metallic quinolinolate and therefore, exhibits an effective long term resistance to fungus, mold and other microbial organisms. Moreover, the substantially complete retention of all the metallic quinolinolates in the web during processing causes the effluent or process waste water to be substantially free of metallic ions. Preferably, the metal content due to the quinolinolate of the total process effluent is below 5 ppm and more preferably below 2 ppm. Thus specialized pollution abatement equipment required in the prior art processes to remove such metals from the process effluent are not required. The prevention of binder coagulation renders the sheet material strong and durable and of uniform consistency.

The following Examples illustrate the typical preparation of the sheet material of the present invention and the physical properties associated therewith:

EXAMPLE I

Control

A pulper was furnished with 2000 lbs. of sulfite pulp and 100 lbs. of ½ inch 2.2 denier nylon fiber to which 45 gallons of a 4.7% solution of a cationic polymer such as the hereinbefore described LUFAX 295 were added. 22.5 gallons (193 lbs.) of the CUNNILATE 2419-75 were added with sufficient sodium aluminate to raise the pH of the admixture to 8.5. The furnish was completed by the addition of 45.5 gallons of a 50% solids styrene-butadiene latex sold under the trade name ARCO SKD 1084 and 1 lb. 5 oz. of a dye to rid the furnish of the green tint caused by the copper-8-quinolinolate.

The resulting furnish was then fed to a Fourdrinier machine forming the furnish into a 48.5 inch wide web.

Following formation, the web was then saturated with a neoprene latex binder, calendered to 0.129 inch and dried.

The sheet material prepared in accordance with Example I had the following initial properties:

| | | |
|---|---|---|
| Gauge (in.) | | 0.129 |
| Lbs./yd.$^2$ | | 4.02 |
| Tensile (lb./in.) | MD[1] | 308 |
| | CD[2] | 190 |
| Elongation % | MD[1] | 16.25 |
| | CD[2] | 26.0 |
| Edge Tear lbs. | MD[1] | 268 |
| | CD[2] | 198 |
| Taber Stiffness | MD[1] | 3150 |
| | CD[2] | 1300 |
| Elmendorf Tear (grams) | MD[1] | 4000 |
| | CD[2] | 5050 |
| Internal Bond (grams) | MD[1] | 3100 |
| | CD[2] | 2200 |
| Mullen (lbs./sq. in.) | | 670 |
| Wet Rub (cycles) | | 55 × 57 |

-continued

| | |
|---|---|
| Flex Endurance[3] (cycles) | 11,198 × 12,375 |

1. MD = Machine Direction
2. CD = Cross Direction
3. Flex Endurance according to SATRA physical test method 129M, 1966.

After aging at room temperature for 5 months, the flexural endurance decreased from 11,198×12,375 to 7000×4000 and after 1 year decreased to 1×1.

EXAMPLE II

Example I was repeated except that the neoprene latex binder was replaced with an acrylic elastomeric binder sold under the trade name NACRYLIC 25-4280 by National Starch & Chemical Corporation. The NACRYLIC 25-4280 latex is a self reactive acrylic latex having acrylonitrile polymerized therein, having a solids of 51% by weight, a pH of 2.9, a viscosity of 100 centipoise, and is anionic. Typical film properties of the latex are such that the film exhibits 600% elongation, a tensile strength of 350 psi, a second order glass transition temperature of 4° C. and a Sward Rocker Hardness of 0. The ARCO SKD 1084 was replaced with Polymerics 410 acrylic resin emulsion. The copper concentration of the total process effluent was less than 0.50 ppm representing substantially complete retention of the copper-quinolinolate.

The sheet material prepared in accordance with Example II had the following initial properties:

| | | |
|---|---|---|
| Gauge (in.) | | .123 |
| Lbs./yd.$^2$ | | 3.75 |
| Tensile (lb./in.) | MD | 300 |
| | CD | 190 |
| Elongation % | MD | 15.5 |
| | CD | 24.0 |
| Edge Tear lbs. | MD | 140 |
| | CD | 129 |
| Taber Stiffness | MD | 2775 |
| | CD | 1625 |
| Elmendorf Tear (grams) | MD | 3550 |
| | CD | 4350 |
| Internal Bond (grams) | MD | 1700 |
| | CD | 1450 |
| Mullen lbs./sq. in. | | 530 |
| Wet Rub (cycles) | | 487 × 733 |
| Flex Endurance (cycles) | | 9388 × 5117 |

EXAMPLE III

Example II was repeated except that the gauge of the sheet material was 0.117. The material was subjected to aging at a temperature of 158° F. and removed at intervals of seven days, conditioned for a minimum of 24 hours at 23°±1° C. and 50%±2% relative humidity and tested in the machine direction. The test results were as follows:

| Oven aging, days | 0 | 7 | 14 | 21 | 28 |
|---|---|---|---|---|---|
| Tensile, lbs./in. | 255 | 260 | 254 | 249 | 241 |
| Elongation, % | 14.3 | 13.0 | 12.7 | 13.7 | 13.7 |
| Stiffness, Taber | 2083 | 2172 | 2180 | 2257 | 2150 |
| Flex, SATRA (cycles) | 3284 | 3453 | 2992 | 2319 | 2932 |

The above data demonstrates that the acrylic binder inhibits, if not alleviates, flexural degradation upon aging of sheet material containing metal-quinolinolate.

Although the invention has been described by specific materials and specific processes, it is only to be limited so far as is set forth in the accompanying claims.

I claim:

1. In a synthetic sheet material resistant to decay by fungus and other microbial organisms and which includes a uniform distribution of fibers and metal-quinolinolate within a binder; the improvement comprising said binder being an acrylic elastomeric binder in a sufficient amount to retard the flexural degradation of said sheet material upon aging.

2. A synthetic sheet material comprising:
an acrylic elastomeric binder;
fibers uniformly distributed throughout said binder;
a sufficient amount of a metal-quinolinate to render said sheet material resistant to decay by microbial organisms; and
said sheet material being resistant to flexural degradation upon aging.

3. The material of claim 2 wherein said metal-quinolinolate is present at a level of 5 to 12 parts by weight based on 100 parts by weight of fiber.

4. The material of claim 2 including a sufficient amount of a cationic polymer to provide retention of substantially all of the metal-quinolinolate within said sheet material.

5. A process for manufacturing a synthetic fibrous sheet material which is resistant to decay according to a papermaking technique including:
providing a furnish of a fibrous slurry, metal-quinolinolate and a cationic polymer;
forming said furnish into a web;
saturating said web with an acrylic elastomeric binder; and
drying said web to form a fibrous sheet.

* * * * *

REEXAMINATION CERTIFICATE (192nd)

United States Patent [19] [11] B1 4,315,798

Bodendorf [45] Certificate Issued May 1, 1984

[54] DECAY RESISTANT SHEET MATERIAL WITH RETAINED FLEXIBILITY

[75] Inventor: Warren J. Bodendorf, Montgomery, Mass.

[73] Assignee: Texon Inc., South Hadley, Mass.

Reexamination Request:
No. 90/000,296, Nov. 22, 1982

Reexamination Certificate for:

| | |
|---|---|
| Patent No.: | **4,315,798** |
| Issued: | **Feb. 16, 1982** |
| Appl. No.: | **177,778** |
| Filed: | **Aug. 13, 1980** |

[51] Int. Cl.[3] ..... D21H 5/22
[52] U.S. Cl. ..... 162/161; 162/168.1; 162/168.2; 162/169; 36/43
[58] Field of Search ..... 162/161, 168.1, 168.2; 36/43, 44; 428/904

[56] References Cited

U.S. PATENT DOCUMENTS

| | | | |
|---|---|---|---|
| 1,756,035 | 4/1930 | Rose et al. . | |
| 2,125,947 | 8/1938 | Novak . | |
| 2,558,634 | 6/1951 | Uber . | |
| 2,694,633 | 11/1954 | Pattiloch . | |
| 2,745,744 | 5/1956 | Weidner et al. . | |
| 3,016,325 | 1/1962 | Pattiloch . | |
| 3,033,865 | 5/1962 | Fronmuller et al. . | |
| 3,493,464 | 2/1970 | Bowers et al. | 162/161 |
| 3,713,963 | 1/1973 | Hager | 162/161 |
| 3,790,529 | 2/1974 | Fujimura et al. | 162/168.2 |
| 3,918,981 | 11/1975 | Long | 162/161 |
| 3,998,944 | 12/1976 | Long . | |
| 4,011,130 | 3/1977 | Worden | 162/151 |
| 4,018,647 | 4/1977 | Wietsma | 162/169 |
| 4,176,108 | 11/1979 | Caimi et al. | 427/392 |

FOREIGN PATENT DOCUMENTS

| | | |
|---|---|---|
| 50-13610 | 2/1975 | Japan . |
| 1307988 | 2/1973 | United Kingdom . |
| 1364422 | 8/1979 | United Kingdom . |

OTHER PUBLICATIONS

Technical Report 70-62-PR: Biodegration of Shoeboard and Leatherboard Footwear.
Counter Materials: Marvin Greenberg et al: Apr. 1970 U.S. Army Natick Laboratories.
Military Specification MIL C 41814C, Jun. 8, 1972.
Military Specification MIL C 41814E, Apr. 20, 1978.
Cunilate No. 2419-75: Ventron Corporation, Beverly, Ma. 01915.
Fungicides for Products of the Paper Industry, Tappi: Aug. 1956.
Copper-8-Quinolinolate (Solubilized) as a Wood Preservative: American Wood Preservative Association, 1962.
The Effect of Fungitoxicants on the Physical Properties of Various Elastomers: Mitten et al, 1965.
Acrylic Resins: Horn: Reinbold Plastics, 1962.
Rhoplex Acrylic Emulsion for Paper Saturation: Rohm and Haas Co. 1965.
Improving Paper with Hycar and Good-Rite Latexes: Goodrich Chem. Co.
Characteristic Properties of Acrylic Nonwoven Saturants, Bakule et al: Tappi: 1973.
Neoprene Latex: John C. Carl: Dupont 1962.
Neoprene Treated Paper: C. H. Gelbert: Dupont.
Effect of Fiber, Pulp, and Binder Variables on Characteristics of Wet-Laid Nonwovens: Gill: Tappi 1972.
Change in Pulp Surface Charge During Beater Deposition of Latex: Latimer; Tappi; 1973.
Lufax 295: Rohm and Haas.

*Primary Examiner*—William F. Smith

[57] ABSTRACT

Synthetic sheet material is resistant to decay by fungus and other microbial organisms and particularly useful in shoe construction where flexibility is required. The material comprises a uniform distribution of cellulose and optionally synthetic fiber within an acrylic elastomeric matrix or binder and is formed from a furnish of the fibers; a metallic quinolinolate which lends the material decay resistant; a polymer colloid such as an acrylic latex which prevents the coagulation of the subsequently added acrylic elastomeric binder by the metallic quinolinolate; and a cationic polymer which acts as a retaining agent for the metallic quinolinolate in the synthetic sheet material.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, lines 15–25:

The metal quinolinolate emulsion, preferably a copper-8-quinolinolate is then added in the form of an emulsion to the pulp solution at a concentration of 5 to 12 parts by weight to 100 parts by weight of pulp. The copper-8-quinolinolate is provided in the form of an anionic emulsion and is readily bonded to the cationic polymer at the fiber surfaces. Such an emulsion is available from Ventron Corp. under the name CUNNILATE 2419-75 containing 37.5% weight solids, 7.5% of which comprises copper-8-quinolinolate. *Accordingly in the preferred practise of the invention, the 5 to 12 parts by weight of metal quinolinolate emulsion provides from 0.375 to 0.9 parts by weight metal quinolinolate based on 100 parts by weight fiber.*

AS A RESULT OF REEXAMINATION, IT HAS BEEN DETERMINED THAT:

Claims 1 and 5, having been finally determined to be unpatentable, are cancelled.

Claim 2 is determined to be patentable as amended:

Claims 3 and 4, dependent on an amended claim, are determined to be patentable.

New claims 6–25 are added and determined to be patentable.

2. A synthetic sheet material comprising:

an acrylic elastomeric binder;

fibers *consisting essentially of cellulosic fibers* uniformly distributed throughout said binder;

a sufficient amount of a metal-quinolinolate to render said sheet material resistant to decay by microbial organisms; and said sheet material being resistant to flexural degradation upon aging.

*6. A material of claim 2 where said material includes a polyacrylate polymer colloid in an amount from 5 to 12 parts by weight based on 100 parts by weight of fiber.*

*7. A material of claim 4 where the amount of cationic polymer is from 0.4 to 2.0 parts by weight based on 100 parts by weight fiber.*

*8. A flexible, synthetic sheet material resistant to decay by microbial organisms and to flexural degradation upon aging and consisting essentially of:*

*a. an acrylic elastomeric binder;*

*b. fibers consisting essentially of cellulosic fibers uniformly distributed throughout the binder;*

*c. copper-8-quinolinolate in an amount sufficient to render said sheet material resistant to decay by microbial organisms;*

*d. a cationic polymer in an amount sufficient to provide substantially complete retention of all of the copper-8-quinolinolate within said sheet material; and*

*e. a polyacrylate polymer colloid in an amount between 5 to 12 parts by weight based on 100 parts by weight fiber.*

*9. A sheet material of claim 8 where the amount of copper-8-quinolinolate is from 0.375 to 0.9 parts by weight based on 100 parts by weight fiber.*

*10. A sheet material of claim 8 or claim 9 where the amount of cationic polymer is from 0.4 to 2.0 parts by weight based on 100 parts by weight fiber.*

*11. A sheet material of claim 8 where the fibers include cellulosic fibers and from 0 to about 5 percent by weight synthetic fibers based on the total weight of fibers.*

*12. A sheet material of claim 8 where the cationic polymer is a cationic polyelectrolyte.*

*13. A process for manufacturing a synthetic fibrous sheet material according to papermaking techniques to provide a flexible sheet material which is resistant to decay by microbial organisms and to flexural degradation upon aging, said process comprising the steps of:*

*a. forming a furnish according to the steps of:*

*1. providing a dispersion of fibers consisting essentially of cellulosic fibers,*

*2. adding a cationic polymer in an amount sufficient to provide substantially complete retention of all of the copper-8-quinolinolate added in step 3. below,*

*3. adding an anionic copper-8-quinolinolate emulsion in an amount sufficient to render said sheet material resistant to decay by microbial organisms, and*

*4. adding a polyacrylate polymer colloid in an amount between 5 to 12 parts by weight based on 100 parts by weight fiber;*

*b. forming the furnish into a web;*

*c. saturating the web with an acrylic elastomeric binder; and*

*d. drying the web to form a fibrous sheet with fibers and the copper-8-quinolinolate uniformly distributed throughout the binder.*

*14. A process of claim 13 where the amount of copper-8-quinolinolate in the furnish is from 0.375 to 0.9 parts by weight based on 100 parts by weight fiber.*

*15. A process of claim 13 or claim 14 where the amount of cationic polymer is from 0.4 to 2.0 parts by weight based on 100 parts by weight fiber.*

*16. A process of claim 13 where the fibers include cellulosic fibers and from 0 to about 5 percent by weight synthetic fibers based on the total weight of fibers.*

*17. A process of claim 13 where the cationic polymer is a cationic polyelectrolyte.*

*18. A flexible, synthetic insole resistant to decay by microbial organisms and to flexural degradation upon aging consisting essentially of:*

*a. an acrylic elastomeric binder,*

*b. fibers consisting essentially of cellulosic fibers uniformly distributed throughout the binder,*

*c. copper-8-quinolinolate in an amount sufficient to render said insole resistant to decay by microbial organisms,*

*d. a cationic polyelectrolyte polymer in an amount sufficient to provide substantially complete retention of all of the copper-8-quinolinolate within the insole, and*

*e. a polyacrylate polymer colloid in an amount from 5 to 12 parts by weight based on 100 parts by weight fiber.*

*19. An insole of claim 18 where the amount of copper-8-quinolinolate is from 0.375 to 0.9 parts by weight based on 100 parts by weight fiber.*

*20. An insole of claim 18 or claim 19 where the amount of cationic polymer is from 0.4 to 2.0 parts by weight based on 100 parts by weight fiber.*

*21. An insole of claim 18 where the fibers include cellulosic fibers and from 0 to about 5 percent by weight synthetic fibers based on 100 parts by weight of fibers.*

*22. A flexible, synthetic sheet material resistant to decay by microbial organisms and to flexural degradation upon aging and consisting essentially of:*

*a. an acrylic elastomeric binder,*

*b. fibers consisting essentially of cellulosic fibers uniformly distributed throughout the binder,*

*c. copper-8-quinolinolate in an amount sufficient to render said sheet material resistant to decay by microbial organisms,*

*d. a cationic polymer in an amount sufficient to provide substantially complete retention of all of the copper-8-quinolinolate within said sheet material, and*

*e. a polyacrylate polymer colloid in an amount sufficient to prevent coagulation of said acrylic elastomeric binder by said metal quinolinolate during preparation of said sheet material.*

*23. A process for manufacturing a synthetic fibrous sheet material according to papermaking techniques to provide a flexible sheet material which is resistant to decay by microbial organisms and to flexural degradation upon aging, said process comprising the steps of:*

*a. forming a furnish according to the steps of:*

*1. providing a dispersion of fibers consisting essentially of cellulosic fibers,*

*2. adding a cationic polymer in an amount sufficient to provide substantially complete retention of all of the copper-8-quinolinolate added in step 3. below,*

*3. adding an anionic copper-8-quinolinolate emulsion in an amount sufficient to render said sheet material resistant to decay by microbial organisms, and*

*4. adding a polyacrylate polymer colloid in an amount sufficient to prevent coagulation of the acrylic elastomeric binder added in step c. by the copper-8-quinolinolate;*

*b. forming the furnish into a web;*

*c. saturating the web with an acrylic elastomeric binder; and*

*d. drying the web to form a fibrous sheet with fibers and the copper-8-quinolinolate uniformly distributed throughout the binder.*

*24. A process of claim 23 where the amount of copper-8-quinolinolate is from 0.375 to 0.9 parts by weight based on 100 parts by weight fiber.*

*25. A process of claim 23 where said cationic polymer is present at a concentration of 0.4 to 2.0 parts by weight based on 100 parts by weight fiber.*

* * * * *